US006972099B2

(12) United States Patent
Easter

(10) Patent No.: US 6,972,099 B2
(45) Date of Patent: Dec. 6, 2005

(54) STRIPPABLE CABLE SHIELD COMPOSITIONS

(75) Inventor: Mark R. Easter, Indianapolis, IN (US)

(73) Assignee: General Cable Technologies Corporation, Highland Heights, KY (US)

( * ) Notice: Subject to any disclaimer, the term of this patent is extended or adjusted under 35 U.S.C. 154(b) by 112 days.

(21) Appl. No.: 10/425,675

(22) Filed: Apr. 30, 2003

(65) Prior Publication Data

US 2004/0217329 A1 Nov. 4, 2004

(51) Int. Cl.[7] ..... H01B 1/24; H01B 7/00
(52) U.S. Cl. ..... 252/511; 174/120 SC
(58) Field of Search ..... 252/511; 174/110 R, 174/120 C, 120 SC

(56) References Cited

U.S. PATENT DOCUMENTS

| | | | | |
|---|---|---|---|---|
| 4,150,193 | A | 4/1979 | Burns, Jr. | |
| 4,226,823 | A | 10/1980 | Jansson | |
| 4,246,142 | A | 1/1981 | Ongchim | |
| 4,286,023 | A | 8/1981 | Ongchim | |
| 4,412,938 | A | 11/1983 | Kakizaki et al. | |
| 4,493,787 | A | 1/1985 | Taniguchi et al. | |
| 4,933,107 | A | 6/1990 | Watanabe et al. | |
| 6,274,066 | B1 | 8/2001 | Easter | |
| 6,284,374 | B1 * | 9/2001 | Yamazaki et al. | 428/383 |
| 6,402,993 | B1 * | 6/2002 | Easter | 252/511 |
| 6,491,849 | B1 * | 12/2002 | Easter | 252/511 |

FOREIGN PATENT DOCUMENTS

| | | |
|---|---|---|
| EP | 0 420 271 B1 | 12/1994 |

* cited by examiner

*Primary Examiner*—Mark Kopec

(57) ABSTRACT

A semiconductive resin composition for use as a semiconductive layer in contact with a crosslinked wire and cable insulation layer is disclosed for use where the insulation layer is crosslinked using a peroxide cure system. The resin has a two component base polymer where the first component has a weight average molecular weight of not more than 200,000. The second component is either a polymer having a melting point between 110° C. and 130° C. or a nitrile rubber. The composition also has an adhesion modifying compound different from the base polymer and carbon black. Methods of making the composition and cables using the composition are also disclosed.

50 Claims, No Drawings

STRIPPABLE CABLE SHIELD COMPOSITIONS

FIELD OF THE INVENTION

The invention relates to semiconducting shield compositions for electric power cables having a two-component base polymer system and an adhesion adjusting additive. The invention also relates to such semiconducting shield compositions and the use of these semiconducting shield compositions to manufacture semiconductive shields for use in electric cables, electric cables made from these compositions and methods of making electric cables from these semiconducting shield compositions. The semiconducting shield compositions of the invention may be used as strippable "semiconducting" dielectric shields (also referred to as the core shields, dielectric screen and core screen materials) in power cables with cross linked polymeric insulation, primarily with medium voltage cables having a voltage from about 5 kV up to about 100 kV.

BACKGROUND OF THE INVENTION

Typical power cables generally have one or more conductors in a core that is surrounded by several layers that can include: a first polymeric semiconducting shield layer, a polymeric insulating layer, a second polymeric semiconducting shield layer, a metallic tape shield and a polymeric jacket.

In general, semiconducting dielectric shields can be classified into two distinct types, the first type being a type wherein the dielectric shield is securely bonded to the polymeric insulation so that stripping the dielectric shield is only possible by using a cutting tool that removes the dielectric shield alone with some of the cable insulation. This type of dielectric shield is preferred by companies that believe that this adhesion minimizes the risk of electric breakdown at the interface of the shield and insulation. The second type of dielectric shield is the "strippable" dielectric shield wherein the dielectric shield has a defined, limited, adhesion to the insulation so that the strippable shield can be peeled cleanly away from the insulation without removing any insulation. Current strippable shield compositions for use over insulation selected from polyethylene, cross-linked polyethylenes, or one of the ethylene copolymer rubbers such as ethylene-propylene rubber (EPR) or ethylene-propylene diene terpolymer (EPDM) are usually based on an ethylene-vinyl acetate (EVA) copolymer base resin rendered conductive with an appropriate type and amount of carbon black.

Strippable shield formulations of EVA and nitrile rubbers have been described by Ongchin, U.S. Pat. Nos. 4,286,023 and 4,246,142; Burns et al. EP Application No. 0,420,271B, Kakizaki et al U.S. Pat. No. 4,412,938 and Janssun, U.S. Pat. No. 4,226,823, each reference being herein incorporated by reference into this application. A problem with these strippable shield formulations of EVA and nitrile rubber is that the EVA's needed for this formulation have a relatively high vinyl acetate content to achieve the desired adhesion level with the result that the formulations are more rubbery then is desired for high speed extrusion of a commercial electric cable.

Alternative adhesion-adjusting additives have also been proposed for use with EVA, for example waxy aliphatic hydrocarbons (Watanabe et al. U.S. Pat. No. 4,933,107, herein incorporated by reference); low-molecular weight polyethylene (Burns Jr., U.S. Pat. No. 4,150,193 herein incorporated by reference); silicone oils, rubbers and block copolymers that are liquid at room temperature (Taniguchi et al. U.S. Pat. No. 4,493,787 herein incorporated by reference); chlorosulfonated polyethylene, ethylene-propylene rubbers, polychloroprene, styrene-butadiene rubber, natural rubber (all in Janssun) but the only one that appears to have found commercial acceptance was paraffin waxes.

U.S. Pat. No. 6,284,374 to Yamazaki, et al discloses a multi-component polymer composition for use in strippable semiconductive shields suitable for a polyolefin-insulated wire and cable crosslinked by silane grafting/water crosslinking. The main polymer component of the composition is mainly composed of an ethylene/vinyl acetate copolymer having a weight average molecular weight not less than 300,000.

U.S. Pat. No. 6,274,066 to Easter discloses a strippable semiconductive shield made from a base polymer and an adhesion modifying additive system where the adhesion between the insulation and the semiconductive shield is between 3–26 pounds per ½ inch.

It would be desirable to further improve adhesion levels in strippable semiconductive shield compositions, especially for use with insulation layers crosslinked with peroxide based systems.

SUMMARY OF THE INVENTION

The invention provides remarkably improved adhesion levels in strippable semiconductive shield compositions of less than 3 pounds per ½ inch with insulation layers crosslinked with peroxide based systems. In preferred embodiments of the invention, adhesion levels in strippable semiconductive shield compositions of less than 2 pounds per ½ inch, even about 1 pound per ½ inch, are attained with semiconductive shield compositions in accordance with the invention that are in contact with insulation layers crosslinked with peroxide based systems.

The invention provides a semiconductive resin composition for use as a semiconductive layer in contact with a crosslinked wire and cable insulation layer where the insulation layer is crosslinked using a peroxide cure system. The resin composition comprises 15 to 85 weight percent, based upon the weight of the semiconductive resin composition, of a base polymer comprising at least two components, a first component having a weight average molecular weight of not more than 200,000 and selected from the group consisting of ethylene vinyl acetate copolymers, ethylene alkyl acrylate copolymers wherein the alkyl group is selected from C1 to C6 hydrocarbons, ethylene alkyl methacrylate copolymers wherein the alkyl group is selected from C1 to C6 hydrocarbons and ethylene alkyl acrylate alkyl methacrylate terpolymers wherein the alkyl group is independently selected from C1 to C6 hydrocarbons; a second component selected from the group consisting of polymers having a melting point between 110° C. and 130° C. and nitrile rubbers, wherein the second component is from about 1 to 40 weight percent of the base polymer, and 0.1 to 20 weight percent, based upon the weight of the semiconductive resin composition, of a an adhesion modifying compound different from the base polymer comprising a hydrocarbon wax or ethylene vinyl acetate wax; and 15 to 45 weight percent, based upon the weight of the semiconductive resin composition, of a conductive carbon black in an amount sufficient to give the semiconductive resin composition a resistance below about 550 ohm-meter.

The invention also provides a method of making a semiconductive resin composition in contact with a crosslinked wire and cable insulation layer, where the insulation layer is crosslinked using a peroxide cure system. The method comprises the steps of (a) compounding 15 to 85 weight percent, based upon the weight of the semiconductive resin composition, of a base polymer comprising at least two components, a first component having a weight average molecular weight of not more than 200,000 and selected from the group consisting of ethylene vinyl acetate copolymers, ethylene alkyl acrylate copolymers wherein the alkyl group is selected from C1 to C6 hydrocarbons, ethylene alkyl methacrylate copolymers wherein the alkyl group is selected from C1 to C6 hydrocarbons and ethylene alkyl acrylate alkyl methacrylate terpolymers wherein the alkyl group is independently selected from C1 to C6 hydrocarbons; a second component selected from the group consisting of polymers having a melting point between 110° C. and 130° C. and nitrile rubbers, wherein the second component is from about 1 to 40 weight percent of the base polymer, with 0.1 to 20 weight percent, based upon the weight of the semiconductive resin composition, of a an adhesion modifying compound different from the base polymer comprising a hydrocarbon wax or ethylene vinyl acetate wax; and a conductive carbon black in an amount sufficient to give the semiconductive shield a resistance below about 550 ohm-meter together in a mixer to form a mixture. The mixture is then extruded to form the semiconductive resin composition, where the semiconductive resin composition is in contact with a crosslinked wire and cable insulation layer and the insulation layer is or has been crosslinked using a peroxide cure system.

The invention also provides a medium voltage electric power cable comprising a conductive core, an insulation layer crosslinked using a peroxide cure system, a strippable semiconductive shield formed from the semiconductive resin composition of the invention and a grounded metal wire or tape and a jacket.

DETAILED DESCRIPTION OF THE INVENTION

This invention includes strippable semiconductive shield compositions suitable for use with conventional electrical insulators crosslinked by peroxides, shields made from such compositions, electric power cables employing these strippable semiconductive dielectric shields and methods of making both the semiconductive shields and electric power cables employing these shields.

Conventional electrical insulators used in medium voltage cables include polyethylenes, cross-linked polyethylenes (XLPE), ethylene-propylene rubbers and ethylene propylene diene rubbers (EPDM rubbers). The term polyethylene is meant to include both polymers and copolymers wherein ethylene is the major component, this would include, for example metallocene or single site catalyzed ethylenes that are copolymerized with higher olefins.

The polymers utilized in the protective jacketing, insulating, conducting or semiconducting layers of the inventive cables of the invention may be made by any suitable process which allows for the yield of the desired polymer with the desired physical strength properties, electrical properties, tree retardancy, and melt temperature for processability.

The strippable semiconductive shields of the invention comprise a two-component base polymer, adhesion modifying compounds and conductive carbon blacks. The conductive carbon blacks are added in an amount sufficient to decrease the electrical resistivity to less than 550 ohm-meter. Preferably the resistivity of the semiconductive shield is less than about 250 ohm-meter and even more preferably less than about 100 ohm-meter.

Shield Polymers

The invention provides a semiconductive resin composition for use as a semiconductive layer in contact with a crosslinked wire and cable insulation layer where the insulation layer is crosslinked using a peroxide cure system. The resin composition comprises 15 to 85 weight percent, based upon the weight of the semiconductive resin composition, of a base polymer comprising at least two components.

The first component has a weight average molecular weight of not more than 200,000, preferably not more than 150,000 and more preferably not more than 100,000. The first component is selected from ethylene vinyl acetate copolymers, ethylene alkyl acrylate copolymers wherein the alkyl group is selected from C1 to C6 hydrocarbons, ethylene alkyl methacrylate copolymers wherein the alkyl group is selected from C1 to C6 hydrocarbons and ethylene alkyl acrylate alkyl methacrylate terpolymers wherein the alkyl group is independently selected from C1 to C6 hydrocarbons The base resin is selected from any suitable member of the group consisting of ethylene vinyl acetate copolymers, ethylene alkyl acrylate copolymers wherein the alkyl group is selected from C1 to C6 hydrocarbons, ethylene alkyl methacrylate copolymers wherein the alkyl group is selected from C1 to C6 hydrocarbons and ternary copolymers of ethylene, alkyl acrylates and alkyl methacrylate wherein the alkyl group is independently selected from C1 to C6 hydrocarbons.

The ethylene vinyl acetate copolymer used in the first component can be any EVA copolymer with the following properties: the ability to accept high loadings of conductive carbon filler, elongation of 150 to 250 percent and sufficient melt strength to maintain its shape after extrusion. EVA copolymers with vinyl acetate levels above about 25 percent and below about 45 percent having these properties are known. The EVA copolymers can have a vinyl acetate percentage range of about 25 to 45 percent. A preferred EVA copolymer will have a vinyl acetate percentage range of about 25 to 35 percent and an even more preferred EVA copolymer will have a vinyl acetate percentage of about 28 to 33 percent. The ethylene vinyl acetate copolymer used in the first component has a weight average molecular weight of not more than 200,000, preferably not more than 150,000 and more preferably not more than 100,000.

The ethylene alkyl acrylate copolymers used in the first component can be any suitable ethylene alkyl acrylate copolymers with the following properties: the ability to accept high loadings of conductive carbon filler, elongation of 150 to 250 percent and sufficient melt strength to maintain its shape after extrusion. The alkyl group can be any alkyl group selected from the C1 to C6 hydrocarbons, preferably the C1 to C4 hydrocarbons and even more preferable methyl. Some ethylene alkyl acrylate copolymers with alkyl acrylate levels above about 25 percent and below about 45 percent have these properties. The ethylene alkyl acrylate copolymers can have an alkyl acrylate percentage range of about 25 to 45 percent. A preferred ethylene alkyl acrylate copolymer will have an alkyl acrylate percentage range of about 28 to 40 percent and an even more preferred ethylene alkyl acrylate copolymer will have an alkyl acrylate percentage of about 28 to 33 percent. The ethylene alkyl acrylate copolymer used in the first component has a weight average molecular weight of not more than 200,000, preferably not more than 150,000 and more preferably not more than 100,000.

The ethylene alkyl methacrylate copolymers used in the first component can be any suitable ethylene alkyl methacrylate copolymer with the following properties: the ability to accept high loadings of conductive carbon filler, elongation of 150 to 250 percent and sufficient melt strength to maintain its shape after extrusion. The alkyl group can be any alkyl group selected from the C1 to C6 hydrocarbons, preferably the C1 to C4 hydrocarbons and even more preferable methyl. Some ethylene alkyl methacrylate copolymers with alkyl methacrylate levels above about 25 percent and below about 45 percent have these properties. The ethylene alkyl methacrylate copolymers can have an alkyl methacrylate percentage range of about 25 to 45 percent. A preferred ethylene alkyl methacrylate copolymer will have an alkyl methacrylate percentage range of about 28 to 40 percent and an even more preferred ethylene alkyl methacrylate copolymer will have an alkyl methacrylate percentage of about 28 to 33 percent. The ethylene alkyl methacrylate copolymer used in the first component has a weight average molecular weight of not more than 200,000, preferably not more than 150,000 and more preferably not more than 100,000.

The ternary copolymers of ethylene with alkyl acrylates and alkyl methacrylates used in the first component can be any suitable ternary copolymer with the following properties: the ability to accept high loadings of conductive carbon filler, elongation of 150 to 250 percent and sufficient melt strength to maintain its shape after extrusion. The alkyl group can be any alkyl group independently selected from the C1 to C6 hydrocarbons, preferably the C1 to C4 hydrocarbons and even more preferable methyl. Usually a ternary copolymer will be predominantly either an alkyl acrylate with a small portion of an alkyl methacrylate or an alkyl methacrylate with a small portion of an alkyl acrylate. The proportions of alkyl acrylate and alkyl methacrylate to ethylene will be about the same as the proportions described for ethylene alkyl acrylate copolymers or for ethylene alkyl methacrylate copolymers as well as the molecular weight ranges described for ethylene alkyl acrylate and ethylene alkyl methacrylate. The ternary copolymers of ethylene with alkyl acrylates and alkyl methacrylates used in the first component has a weight average molecular weight of not more than 200,000, preferably not more than 150,000 and more preferably not more than 100,000.

The second component is selected from polymers having a melting point between 110° C. and 130° C. and nitrile rubbers. The second component is from about 1 to 40 weight percent of the base polymer, preferably from about 10 weight percent to about 25 weight percent of the base polymer. In certain preferred embodiments, the second component of the base polymer is selected from polyethylene, polypropylene, polystyrene, ethylene butene and ethylene octene polymers having a melting point between 110° C. and 130° C. In other preferred embodiments, the second component is a nitrile rubber. The nitrile rubbers in accordance with the invention may contain from about 25 to about 55 weight percent of acrylonitrile, preferably from about 30 to 45 weight percent acrylonitrile. Acrylonitrile butadiene copolymers and/or their methods of preparation are well known in the art and have acquired the designation, i.e., they are referred to as nitrile rubbers or NBR. Accordingly, in embodiments of the invention, acrylonitrile-butadiene copolymers may be used as the nitrile rubber. Hydrogenated nitrile and isoprene-acrylonitrile polymers are also suitable as the second component of the invention, and in the context of the invention, are considered nitrile rubbers as well. Blends of any of the above nitrile rubbers also are considered to fall within the meaning of nitrile rubbers as set forth herein. These nitrile rubber polymers are commercially available from Zeon Chemical, Goodyear, Polysar and other suppliers.

Adhesion Modifying Component

The adhesion modifying compounds are different from the base polymer and are any suitable ethylene vinyl acetate copolymers with a weight average molecular weight greater than about 10,000, preferably greater than about 12,000, and more preferably greater than about 15,000. A preferred ethylene vinyl acetate copolymer will have a weight average molecular weight from about 22,500 to about 50,000 and an even more preferred EVA copolymer will have a weight average molecular weight from about 25,000 to about 40,000. The adhesion modifying ethylene vinyl acetate copolymers of the invention will have a polydispersivity greater than about 2.5 preferably a polydispersivity greater than 4 and even more preferably a polydispersivity greater than 5. Polydispersity is $M_W$ divided by $M_N$ (number average molecular weight) and is a measure of the distribution of the molecular weights of the polymer chains. The proportion of vinyl acetate in the adhesion modifying ethylene vinyl acetate copolymers of the invention should be about 10 to 28 percent, preferably about 12 to 25 and even more preferably about 12 to 20 percent vinyl acetate. Suitable commercially available material includes AC 415, a 15 percent vinyl acetate wax available from Honeywell Inc. of Morristown, N.J.

The adhesion modifying compounds can also include any suitable ethylene alkyl acrylate or ethylene alkyl methacrylate copolymer wherein the alkyl group is selected from the C1 to C6 hydrocarbons and with a weight average molecular weight greater than about 10,000, preferably greater than about 12,000, and more preferably greater than about 15,000. A preferred ethylene alkyl acrylate or ethylene alkyl methacrylate copolymer will have a weight average molecular weight from about 22,500 to about 50,000 and an even more preferred ethylene alkyl acrylate or ethylene alkyl methacrylate copolymer will have a weight average molecular weight from about 25,000 to about 40,000. The adhesion modifying ethylene alkyl acrylate or ethylene alkyl methacrylate copolymers of the invention will have a polydispersivity greater than about 2.5 preferably a polydispersivity greater than 4 and even more preferably a polydispersivity greater than 5. Polydispersity, as previously defined, is $M_W$ divided by $M_N$ and is a measure of the distribution of the molecular weights of the polymer chains. The proportion of alkyl acrylate or alkyl methacrylate in the adhesion modifying ethylene alkyl acrylate or ethylene alkyl methacrylate copolymers of the invention should be about 10 to 28 percent, preferably about 12 to 25 and even more preferably about 12 to 20 percent alkyl acrylate. The alkyl group is selected from the C1 to C6 hydrocarbons, preferably the C1 to C4 hydrocarbons and even more preferably methyl.

The conductive carbon black can be any conductive carbon blacks in an amount sufficient to decrease the electrical resistivity to less than 550 ohm-meter. Preferably the resistivity of the semiconductive shield is less than about 250 ohm-meter and even more preferably less than about 100 ohm-meter. Suitable carbon blacks include N351 carbon blacks and N550 carbon blacks sold by Cabot Corp. of Boston Mass.

N351 and N550 are commercial carbon black grades described in ASTM D 1765 98b.

The strippable semiconductive shield formulations of the invention can be compounded by a commercial mixer such as a Banbury mixer, a twin screw extruder a Buss Ko Neader or other continuous mixers. The proportion of the adhesion modifying compound to the other compounds in the strippable semiconductive shield will vary depending on the base polymer, underlying insulation, molecular weight of the adhesion modifying compound and polydispersity of the adhesion modifying compound. A strippable shield formulation can be made by compounding 30 to 45 percent by weight carbon black with 0.5 to 10 percent by weight adhesion modifying compound, and the balance the base polymer, optionally any one of, the following components may be added 0.05 to 3.0 percent by weight process aid, 0.05 to 3.0 percent by weight antioxident, 0.1 to 3.0 percent by weight cross-linking agent. Another strippable shield formulation can have 33 to 42 percent by weight carbon black, 1.0 to 7.5 weight percent adhesion modifying compound and the balance base polymer optionally any one of, the following components may be added: 0.1 to 2.0 percent by weight process aid, 0.1 to 2.0 percent by weight antioxident, 0.5 to 2.0 percent by weight cross-linking agent. Still another strippable shield formulation can have 35 to 40 percent by weight carbon black, 2.0 to 7.0 percent by weight adhesion modifying compound, and the balance base polymer optionally any one of, the following components may be added: 0.25 to 1.5 percent by weight process aid, 0.25 to 1.5 percent by weight antioxident, 1.0 to 2.0 percent by weight cross-linking agent. The strippable shield formulation can be compounded by mixing the carbon black, adhesion modifying compound, processing aid, anti-oxident and two-component base polymer together in a continuous mixer until well mixed. If a cross-linking agent is to be added it may be added in a second mixing step or absorbed into the polymer mass after mixing. After addition of the cross-linking agent the formulation is ready to be extruded onto the insulation and cross-linked to form the strippable semiconductive shield.

Insulation Composition

Conventional electrical insulators used in medium voltage cables include polyethylenes, cross-linked polyethylenes (XLPE), ethylene-propylene rubbers and ethylene propylene diene rubbers (EPDM rubbers). The term polyethylene is meant to include both polymers and copolymers wherein ethylene is the major component, this would include, for example metallocene or single site catalyzed ethylenes that are copolymerized with higher olefins.

The insulation compositions for use with the semiconductive resin composition of the invention are cross-linked using a peroxide cure system. The cross linking agent can be chosen from any of the well known peroxide cross-linking agents known in the art including that form free radicals and cross-link by a free radical mechanism.

The insulating composition the invention may or may not be filled. An illustrative example of a suitable filler is clay, talc (aluminum silicate or magnesium silicate), magnesium aluminum silicate, magnesium calcium silicate, calcium carbonate, magnesium calcium carbonate, silica, ATH, magnesium hydroxide, sodium borate, calcium borate, kaolin clay, glass fibers, glass particles, or mixtures thereof. In accordance with the invention, the weight percent range for fillers is from about 10 percent to about 60 percent, preferably from about 20 to about 50 weight percent filler.

Other additives commonly employed in the polyolefin compositions utilized in the invention can include, for example, crosslinking agents, antioxidants, processing aids, pigments, dyes, colorants, metal deactivators, oil extenders, stabilizers, and lubricants.

All of the components of the compositions utilized in the invention are usually blended or compounded together prior to their introduction into an extrusion device from which they are to be extruded onto an electrical conductor. The polymer and the other additives and fillers may be blended together by any of the techniques used in the art to blend and compound such mixtures to homogeneous masses. For instance, the components may be fluxed on a variety of apparatus including multi-roll mills, screw mills, continuous mixers, compounding extruders and Banbury mixers.

After the various components of the composition are uniformly admixed and blended together, they are further processed to fabricate the cables of the invention. Prior art methods for fabricating polymer insulated cable and wire are well known, and fabrication of the cable of the invention may generally be accomplished any of the various extrusion methods.

In a typical production method for a peroxide cross-linked insulation layer of a cable, an (optionally) heated conducting core to be coated is pulled through a heated extrusion die, generally a cross-head die, in which a layer of melted polymer is applied to the conducting core. Upon exiting the die, the conducting core with the applied polymer layer is passed through a heated vulcanizing section, or continuous vulcanizing section where they are completely cross-linked in a short time, and then a cooling section, generally an elongated cooling bath, to cool. Multiple polymer layers may be applied by consecutive extrusion steps in which an additional layer is added in each step, or with the proper type of die, multiple polymer layers may be applied simultaneously. The semiconductive shield, insulating layer and strippable semiconductive shield are then passed through a heated vulcanizing section, or continuous vulcanizing section where all three layers are cross-linked simultaneously and then a cooling section, generally an elongated cooling bath, to cool. The vulcanizing section is heated as hot as possible without thermally decomposing the polymer layers of the cable.

In other production methods for producing a peroxide cross-linked insulation layer of a cable, the extruded core and polymer layers are passed through a heated salt bath or an electron beam section where all three layers are cross-linked simultaneously. In yet another method, the extruded core and polymer layers are passed through a heated bath of lead or heated lead is extruded over the core and the heat energy in the lead cures the cable in a short time.

In contrast, moisture crosslinked cables are typically extruded directly into a elongated cooling trough and cooled in an uncross-linked state. The process used is the same as that for the production of a thermoplastic cable that is not cross-linked. The moisture cross-linkable cable is then placed in a bath of hot water or in a source of steam, sometimes referred to as a "sauna", where it slowly cures over time. The rate of cure is dependent on the thickness and the moisture permeability of the layers of the cable and the type of catalyst used and can range from several hours to several days. While heat slightly increases the rate at which water permeates the cable, the temperature must be kept below the melting point of the outer layer of the cable to prevent it softening and sticking to itself. Because of this moisture cure is undesirable for cables of higher voltage that require thicker layers of insulation. The number of water tanks or saunas required becomes too great.

The conductor of the invention may generally comprise any suitable electrically conducting material, although generally electrically conducting metals are utilized. Preferably, the metals utilized are copper or aluminum. In power transmission, aluminum conductor/steel reinforcement (ACSR) cable, aluminum conductor/aluminum reinforcement (ACAR) cable, or aluminum cable is generally preferred.

The weight average molecular weight may be measured by light scattering or by other conventional means. The number average molecular weight may be measured by osmometry or by other conventional means. The melting point may be measured based on the melting point determined from a crystal melting peak obtained using a differential scanning calorimeter, or by other conventional means.

Experimental

The compositions described in the examples were made up by the procedure set out below, and made up into molded plaques measuring 150 mm square by 2 mm thick, one face being plaques measuring 150 mm square by 2 mm thick, one face being bonded to an XLPE block of the same dimensions and the two compositions cured together in the press for 20 minutes at 180° C. In each case adhesion was measured by the peel strength tests detailed below. Identification of ingredients also follows.

Batches of about 1350 g (3.3 lb) of each composition were made up using a Farrell model BR Banbury mixer with a capacity of 1.57 1. All of the ingredients were added to the Banbury mixer and the ram was lowered. They were then mixed for two minutes at the middle speed setting. The mixture was discharged, milled into a flat sheet and promptly molded.

Plaque samples were tested by cutting completely through the thickness of the layer of the experimental shield composition in parallel lines to define a strip 12.5 m (½ inch) wide; one end was lifted and turned back 180° to lie along the surface of the portion still adhered, and the force required to peel at a rate of 0.0085 m/s (20 in/min) measured; peel strength was calculated in N/m and pounds per ½ inch.

Ingredients

AC 415 is an ethylene vinyl acetate wax with 14–16 percent vinyl acetate, a molecular weight of 22,500–50,000 daltons and a polydispersivity of 2.5–10.

Dow Resin 0693 is a proprietary formulation manufactured by Dow Chemical, Midland, Mich., that contains about 36% carbon black, a polymer that melts between 110° C. and 130° C., about 1% organic peroxide, and the remainder 32% vinyl acetate content ethylene vinyl acetate.

Borealis Resin LE310MS is a proprietary formulation manufactured by Borealis Compounds LLC, Rockport, N.J., that contains about 36% carbon black, about 15% nitrile rubber, 1% organic peroxide, and the remainder 32% vinyl acetate content ethylene vinyl acetate.

General Cable Resin LS567A is a formulation manufactured by General Cable Corporation of Indianapolis, Ind. that contains 36% carbon black, 4% AC415, 1% organic peroxide, less than 1% of antioxidants and processing aids, and the remainder 32% vinyl acetate content ethylene vinyl acetate.

Examples 1–4 are comparative examples showing adhesion results for a one component base polymer system using an adhesion modifying compound (examples 1 & 2) and adhesion results for a two component base polymer system with no adhesion modifying compound (examples 3 & 4). Example 5 and example 6 are in accordance with the invention, although they are not intended to limit the scope of the invention or the claims appended hereto.

In Example 1, 100 percent by weight of General Cable Resin LS567A, manufactured by General Cable Corporation of Indianapolis, Ind. was used to generate adhesion data in accordance with the experimental procedure set forth above. General Cable Resin LS567A contains 36% carbon black, approximately 4% AC415 adhesion modifying compound, 1% organic peroxide, less than 1% of antioxidants and processing aids, and the remainder 32% vinyl acetate content ethylene vinyl acetate. The adhesion results obtained were 10.0 pounds per ½ inch.

In Example 2, 3 weight percent of AC415 was added to 97 weight percent of General Cable Resin LS567A to generate adhesion data in accordance with the experimental procedure set forth above. This increased the AC415 level to approximately 7 weight percent. The adhesion results obtained were 11.0 pounds per ½ inch.

In Example 3, 100 percent by weight of Borealis Resin LE310MS, a proprietary formulation manufactured by Borealis Compounds LLC, Rockport, N.J., was used to generate adhesion data in accordance with the experimental procedure set forth above. The adhesion results obtained were 3.1 pounds per ½ inch.

In Example 4, 100 percent by weight of Dow Resin 0693, a proprietary formulation manufactured by Dow Chemical, Midland, Mich., was used to generate adhesion data in accordance with the experimental procedure set forth above. The adhesion results obtained were 7.3 pounds per ½ inch.

In Example 5 in accordance with the invention, 3 weight percent of AC415 was added to 97 weight percent of Borealis Resin LE310MS to generate adhesion data in accordance with the experimental procedure set forth above. The adhesion results obtained were 1.1 pounds per ½ inch.

In Example 6 in accordance with the invention, 3 weight percent of AC415 was added to 97 weight percent of Dow Reson 0693 to generate adhesion data in accordance with the experimental procedure set forth above. The adhesion results obtained were 1.6 pounds per ½ inch.

As can be seen from the data, the addition of 3% AC 415 remarkably reduces the adhesion level by a factor of at least three with nitrile rubber (Borealis LE310MS 3.1/1.1) and in another instance a reduction of over four times the adhesion level occurred (Dow 0693 7.3/1.6).

These experimental data are by no means exhaustive of the possible formulations or results encompassed by the invention. For this reason, then, reference should be made solely to the appended claims for the purposes of determining the true scope of this invention.

What is claimed is:

1. A semiconductive resin composition for use as a semiconductive layer in contact with a crosslinked wire and cable insulation layer, wherein said insulation layer is crosslinked using a peroxide cure system, said resin composition comprising, 15 to 85 weight percent, based upon the weight of the semiconductive resin composition, of a base polymer comprising at least two components, a first component having a weight average molecular weight of not more than 200,000 and selected from the group consisting of ethylene vinyl acetate copolymers, ethylene alkyl acrylate copolymers wherein the alkyl group is selected from C1 to C6 hydrocarbons, ethylene alkyl methacrylate copolymers wherein the alkyl group is selected from C1 to C6 hydrocarbons and ethylene alkyl acrylate alkyl methacrylate terpolymers wherein the alkyl group is independently selected from C1 to C6 hydrocarbons; a second component selected from the group consisting of polymers having a melting point between 110° C. and 130° C. and nitrile rubbers , wherein said second component is from about 1 to 40 weight percent of the base polymer, and 0.1 to 20 weight percent, based upon the weight of the semiconductive resin composition, of a an adhesion modifying compound different from said base polymer comprising a hydrocarbon wax or ethylene vinyl acetate wax; and 15 to 45 weight percent, based upon the weight of the semiconductive resin composition, of a conductive carbon black in an amount sufficient to give the semiconductive resin composition a resistance below about 550 ohm-meter; wherein said semiconductive resin composition forms a strippable semiconductive layer in contact with said peroxide crosslinked insulation layer.

2. The semiconductive resin composition of claim 1 wherein the first component of the base polymer comprises ethylene vinyl acetate copolymer.

3. The semiconductive resin composition of claim 2 wherein said ethylene vinyl acetate has from about 25% to about 35% vinyl acetate.

4. The semiconductive resin composition of claim 3 wherein the second component of the base polymer is a nitrile rubber and is from about 10 to about 20 weight percent of the base polymer.

5. The semiconductive resin composition of claim 1 wherein the adhesion modifying compound comprises an ethylene vinyl acetate wax with 14–16 percent vinyl acetate, a molecular weight of 22,500–50,000 and a polydispersivity of 2.5–10.

6. The semiconductive resin composition of claim 3 wherein the adhesion modifying compound comprises an ethylene vinyl acetate wax with 14–16 percent vinyl acetate, a molecular weight of 22,500–50,000 and a polydispersivity of 2.5–10.

7. The semiconductive resin composition of claim 1 wherein the second component of the base polymer is a nitrile rubber and is from about 10 to about 20 weight percent of the base polymer.

8. The semiconductive resin composition of claim 1 wherein the second component of the base polymer is selected from polyethylene, polypropylene, polystyrene, ethylene butene and ethylene octene polymers having a melting point between 110° C. and 130° C.

9. The semiconductive resin composition of claim 3 wherein the second component of the base polymer is selected from polyethylene, polypropylene, polystyrene, ethylene butene and ethylene octene polymers having a melting point between 110° C. and 130° C.

10. The semiconductive resin composition of claim 1 wherein the carbon black is selected from N550 and N351 type carbon blacks.

11. The semiconductive resin composition of claim 1 further comprising a cross-linking agent.

12. The semiconductive resin composition of claim 1 having 30 to 45 percent by weight carbon black and 0.5 to 10 percent by weight adhesion modifier.

13. The semiconductive resin composition of claim 1 having 33 to 42 percent by weight carbon black and 1.0 to 7.5 weight percent adhesion modifying compound.

14. The semiconductive resin composition of claim 1, wherein the adhesion modifying compound comprises a hydrocarbon wax or ethylene vinyl acetate wax having weight average molecular weight greater than 10,000.

15. The semiconductive resin composition of claim 1, wherein the adhesion modifying compound comprises a hydrocarbon wax or ethylene vinyl acetate wax having weight average molecular weight greater than 12,000.

16. The semiconductive resin composition of claim 1, wherein the adhesion modifying compound comprises a hydrocarbon wax or ethylene vinyl acetate wax having weight average molecular weight greater than 15,000.

17. The semiconductive resin composition of claim 1 wherein said nitrile rubber contains from about 30 to 45 weight percent acrylonitrile.

18. The semiconductive resin composition of claim 1 wherein said nitrile rubber is selected from acrylonitrile butadiene copolymers, hydrogenated nitrile polymers, isoprene-acrylonitrile polymers, and mixtures or blends thereof.

19. A method of making a semiconductive resin composition in contact with a crosslinked wire and cable insulation layer, wherein said insulation layer is crosslinked using a peroxide cure system, comprising the steps of:

(a) compounding 15 to 85 weight percent, based upon the weight of the semiconductive resin composition, of a base polymer comprising at least two components, a first component having a weight average molecular weight of not more than 200,000 and selected from the group consisting of ethylene vinyl acetate copolymers, ethylene alkyl acrylate copolymers wherein the alkyl group is selected from C1 to C6 hydrocarbons, ethylene alkyl methacrylate copolymers wherein the alkyl group is selected from C1 to C6 hydrocarbons and ethylene alkyl acrylate alkyl methacrylate terpolymers wherein the alkyl group is independently selected from C1 to C6 hydrocarbons; a second component selected from the group consisting of polymers having a melting point between 110° C. and 130° C. and nitrile rubbers , wherein said second component is from about 1 to 40 weight percent of the base polymer, with;

0.1 to 20 weight percent, based upon the weight of the semiconductive resin composition, of a an adhesion modifying compound different from said base polymer comprising a hydrocarbon wax or ethylene vinyl acetate wax; and a conductive carbon black in an amount sufficient to give the semiconductive shield a resistance below about 550 ohm-meter together in a mixer to form a mixture, (b) extruding the mixture to form the semiconductive resin composition, wherein said semiconductive resin composition forms a strippable semiconductive layer in contact with said peroxide crosslinked wire and cable insulation layer.

20. The method of making a semiconductive resin composition of claim 19 wherein the first component of the base polymer comprises ethylene vinyl acetate copolymer.

21. The method of making a semiconductive resin composition of claim 20 wherein said ethylene vinyl acetate has from about 25% to about 35% vinyl acetate.

22. The method of making a semiconductive resin composition of claim 21 wherein the second component of the base polymer is a nitrile rubber and is from about 10 to about 20 weight percent of the base polymer.

23. The method of making a semiconductive resin composition of claim 21 wherein the second component of the base polymer is selected from polyethylene, polypropylene, polystyrene, ethylene butene and ethylene octene polymers having a melting point between 110° C. and 130° C.

24. The method of making a semiconductive resin composition of claim 21 wherein the adhesion modifying compound comprises an ethylene vinyl acetate wax with 14–16 percent vinyl acetate, a molecular weight of 22,500–50,000 and a polydispersivity of 2.5–10.

25. The method of making a semiconductive resin composition of claim 19 wherein the second component of the base polymer is a nitrile rubber and is from about 10 to about 20 weight percent of the base polymer.

26. The method of making a semiconductive resin composition of claim 19 wherein the second component of the base polymer is selected from polyethylene, polypropylene, polystyrene, ethylene butene and ethylene octene polymers having a melting point between 110° C. and 130° C.

27. The method of making a semiconductive resin composition of claim 19 wherein the adhesion modifying compound comprises an ethylene vinyl acetate wax with 14–16 percent vinyl acetate, a molecular weight of 22,500–50,000 and a polydispersivity of 2.5–10.

28. The method of making a semiconductive resin composition of claim 19 wherein the carbon black is selected from N550 and N351 type carbon blacks.

29. The method of making a semiconductive resin composition of claim 19 further comprising a adding cross-linking agent to the semiconductive resin composition.

30. The method of making a semiconductive resin composition of claim 19 wherein said semiconductive resin composition has 30 to 45 percent by weight carbon black and 0.5 to 10 percent by weight adhesion modifier.

31. The method of making a semiconductive resin composition of claim 19 wherein said semiconductive resin composition has 33 to 42 percent by weight carbon black and 1.0 to 7.5 weight percent adhesion modifying compound.

32. The method of making a semiconductive resin composition of claim 19, wherein the adhesion modifying compound comprises a hydrocarbon wax or ethylene vinyl acetate wax having weight average molecular weight greater than 10,000.

33. The method of making a semiconductive resin composition of claim 19, wherein the adhesion modifying compound comprises a hydrocarbon wax or ethylene vinyl acetate wax having weight average molecular weight greater than 12,000.

34. The method of making a semiconductive resin composition of claim 19, wherein the adhesion modifying compound comprises a hydrocarbon wax or ethylene vinyl acetate wax having weight average molecular weight greater than 15,000.

35. A medium voltage electric power cable comprising a conductive core, an insulation layer crosslinked using a peroxide cure system, a strippable semi-conductive shield formed from a semiconductive resin composition, a grounded metal wire or tape and a jacket; wherein said semiconductive resin composition comprises, 15 to 85 weight percent, based upon the weight of the semiconductive resin composition, of a base polymer comprising at least two components, a first component having a weight average molecular weight of not more than 200,000 and selected from the group consisting of ethylene vinyl acetate copolymers, ethylene alkyl acrylate copolymers wherein the alkyl group is selected from C1 to C6 hydrocarbons, ethylene alkyl methacrylate copolymers wherein the alkyl group is selected from C1 to C6 hydrocarbons and ethylene alkyl acrylate alkyl methacrylate terpolymers wherein the alkyl group is independently selected from C1 to C6 hydrocarbons; a second component selected from the group consisting of polymers having a melting point between 110° C. and 130° C. and nitrile rubbers , wherein said second component is from about 1 to 40 weight percent of the base polymer, and 0.1 to 20 weight percent, based upon the weight of the semiconductive resin composition, of a an adhesion modifying compound different from said base polymer comprising a hydrocarbon wax or ethylene vinyl acetate wax; and 15 to 45 weight percent, based upon the weight of the semiconductive resin composition, of a conductive carbon black in an amount sufficient to give the semiconductive resin composition a resistance below about 550 ohm-meter.

36. The electric power cable of claim 35 wherein the first component of the base polymer comprises ethylene vinyl acetate copolymer.

37. The electric power cable of claim 36 wherein said ethylene vinyl acetate has from about 25% to about 35% vinyl acetate.

38. The electric power cable of claim 37 wherein the second component of the base polymer is a nitrile rubber and is from about 10 to about 20 weight percent of the base polymer.

39. The electric power cable of claim 37 wherein the second component of the base polymer is selected from polyethylene, polypropylene, polystyrene, ethylene butene and ethylene octene polymers having a melting point between 110° C. and 130° C.

40. The electric power cable of claim 37 wherein the adhesion modifying compound comprises an ethylene vinyl acetate wax with 14–16 percent vinyl acetate, a molecular weight of 22,500–50,000 daltons and a polydispersivity of 2.5–10.

41. The electric power cable of claim 35 wherein the second component of the base polymer is a nitrile rubber and is from about 10 to about 20 weight percent of the base polymer.

42. The electric power cable of claim 35 wherein the second component of the base polymer is selected from polyethylene, polypropylene, polystyrene, ethylene butene and ethylene octene polymers having a melting point between 110° C. and 130° C.

43. The electric power cable of claim 35 wherein the adhesion modifying compound comprises an ethylene vinyl acetate wax with 14–16 percent vinyl acetate, a molecular weight of 22,500–50,000 daltons and a polydispersivity of 2.5–10.

44. The electric power cable of claim 35 wherein the carbon black is selected from N550 and N351 type carbon blacks.

45. The electric power cable of claim 35 further comprising a cross-linking agent.

46. The electric power cable of claim 35 having 30 to 45 percent by weight carbon black and 0.5 to 10 percent by weight adhesion modifier.

47. The electric power cable of claim 35 having 33 to 42 percent by weight carbon black and 1.0 to 7.5 weight percent adhesion modifying compound.

48. The electric power cable of claim 35, wherein the adhesion modifying compound comprises a hydrocarbon wax or ethylene vinyl acetate wax having weight average molecular weight greater than 10,000.

49. The electric power cable of claim 35, wherein the adhesion modifying compound comprises a hydrocarbon wax or ethylene vinyl acetate wax having weight average molecular weight greater than 12,000.

50. The electric power cable of claim 35, wherein the adhesion modifying compound comprises a hydrocarbon wax or ethylene vinyl acetate wax having weight average molecular weight greater than 15,000.

* * * * *